US008499728B2

(12) United States Patent
Xie et al.

(10) Patent No.: US 8,499,728 B2
(45) Date of Patent: Aug. 6, 2013

(54) CYLINDER LINKAGE METHOD FOR A MULTI-CYLINDER INTERNAL-COMBUSTION ENGINE AND A MULTICYLINDER LINKAGE COMPOUND INTERNALCOMBUSTION ENGINE

(75) Inventors: Shengli Xie, Wenling (CN); Linghui Xie, Wenling (CN)

(73) Assignee: Shengli Xie, Wenling, Zhejiang (CN)

( * ) Notice: Subject to any disclaimer, the term of this patent is extended or adjusted under 35 U.S.C. 154(b) by 285 days.

(21) Appl. No.: 12/865,849

(22) PCT Filed: Jan. 20, 2009

(86) PCT No.: PCT/CN2009/070222

§ 371 (c)(1),
(2), (4) Date: Aug. 2, 2010

(87) PCT Pub. No.: WO2009/097787

PCT Pub. Date: Aug. 13, 2009

(65) Prior Publication Data

US 2010/0307432 A1 Dec. 9, 2010

(30) Foreign Application Priority Data

Feb. 3, 2008 (CN) ..... 2008 1 0059693

(51) Int. Cl.
*F02B 75/18* (2006.01)

(52) U.S. Cl.
USPC ..... 123/53.6; 123/53.3; 123/55.4

(58) Field of Classification Search
USPC ..... 123/53.6, 53.3, 53.1, 55.2, 55.4, 123/56.1, 58.1, 54.2, 54.8
See application file for complete search history.

(56) References Cited

U.S. PATENT DOCUMENTS 2,229,788 A * 1/1941 Appleton ..... 74/51
2,241,630 A * 5/1941 Brill ..... 123/54.8

(Continued)

FOREIGN PATENT DOCUMENTS

CN 12300629 A 10/1999

(Continued)

OTHER PUBLICATIONS

Machine translatation of JP 10-317987A, Detailed Description, "JP10-317987_Translation.pdf".*

*Primary Examiner* — Noah Kamen
*Assistant Examiner* — Long T Tran
(74) *Attorney, Agent, or Firm* — Karim Lagobi

(57) ABSTRACT

A cylinder linkage method for a multi-cylinder internal-combustion engine comprising connecting piston rods (27) and pistons (28) of four or more linkage combustion and compression reversible cylinder blocks (14A, 14B, 14C, 14D, 30A, 30B, 30C, 30D) and of reversible precompression cylinder blocks (3, 8) simultaneously by one linkage rod (26), such that the linkage rod (26) is able to drive the linkage pistons (28) to move in the same direction simultaneously and to arrive at a top dead center or a bottom dead center or any same stroke position between the two dead centers of all the linkage cylinder blocks simultaneously. The cylinder linkage method for a multi-cylinder internal-combustion engine can be used to manufacture a multi-cylinder linkage compound internal-combustion engine, and further used to manufacture internal-combustion engines such as gasoline internal-combustion engine, diesel internal-combustion engine, natural gas internal-combustion engine etc. in combination with multi-level precompression, multi-level intercooling and power turbine (21).

6 Claims, 5 Drawing Sheets

U.S. PATENT DOCUMENTS

| | | | | |
|---|---|---|---|---|
| 2,466,550 | A * | 4/1949 | Lundquist | 123/54.2 |
| 2,807,136 | A * | 9/1957 | Foster | 60/247 |
| 3,269,321 | A * | 8/1966 | Eickmann | 417/339 |
| 3,868,932 | A * | 3/1975 | Toth | 123/53.4 |
| 4,038,954 | A * | 8/1977 | Franke | 123/318 |
| 4,876,991 | A * | 10/1989 | Galitello, Jr. | 123/46 E |
| 5,072,589 | A * | 12/1991 | Schmitz | 60/622 |
| 5,189,994 | A * | 3/1993 | Gindentuller | 123/54.2 |
| 5,526,779 | A * | 6/1996 | Harrington | 123/61 R |
| 5,862,781 | A * | 1/1999 | Rossle | 123/55.7 |
| 6,871,497 | B2 * | 3/2005 | Isogai | 60/598 |
| 7,100,546 | B2 * | 9/2006 | Sorochkin et al. | 123/46 R |
| 2005/0028760 | A1 * | 2/2005 | Akihisa et al. | 123/48 R |
| 2006/0027203 | A1 * | 2/2006 | Cunningham et al. | 123/184.47 |

FOREIGN PATENT DOCUMENTS

| | | | |
|---|---|---|---|
| CN | 201013445 | Y | 1/2008 |
| CN | 101225765 | A | 7/2008 |
| DE | 10107921 | A1 | 1/2002 |
| DE | 102006033960 | A1 | 1/2008 |
| JP | 10-317987 | | 12/1998 |

* cited by examiner

CYLINDER LINKAGE METHOD FOR A MULTI-CYLINDER INTERNAL-COMBUSTION ENGINE AND A MULTICYLINDER LINKAGE COMPOUND INTERNALCOMBUSTION ENGINE

FIELD OF THE INVENTION

The present invention relates to a field of internal-combustion engine technology, and in particular, to a cylinder linkage method for a multi-cylinder internal-combustion engine and a multi-cylinder linkage compound internal-combustion engine.

DESCRIPTION OF THE RELATED ART

It has been known in the prior arts that internal-combustion engine is one kind of the thermal engines, that is, the machine that transfers chemical energy released from a fuel into mechanical output. With the development of conventional reciprocating internal-combustion engine over one century, this technology tends to reach perfect but its potential is on the decline. Further, it seems to be extremely difficult to improve its efficiency. Recently, with the appearance of the Miller Cycle theory and new technologies like exhaust-driven turbocharge, this effectiveness has been significantly improved. However, the efficiency and potential are necessarily confined for a certain extent based upon the utilization of discharge gas energy because of the structure of the internal-combustion engine.

Energy problem always has been one of the severe problems in modern society. The present invention aims to achieve higher power output efficiency and greater power density, to speed up the social civilization. As known from Carnot's theorem, the increase of the compression ratio (i.e., the increase of the temperature difference of the heat reservoir) improves power output transition efficiency of the internal-combustion engine. However, in the conventional reciprocating internal-combustion engine, the compression ratio is not yet effectively enhanced due to the restriction from mechanical load of the crank link system. Theoretically, as known from standard four-stroke cycle of the internal-combustion engine, the continuity of the circulation will be kept only when work, by the strokes, is transferred to crank link mechanism to satisfy both the one come back to the working fluid by the link lever and the one to the external side by the crank. If the work come back to the working fluid, as the internal energy, may run away from the crank link system, the internal-combustion engine will break away from the situation where efficiency of the internal-combustion engine is limited by the mechanical load of the crank link system, so as to greatly improve thermal efficiency. The present invention provides the principle of energy distribution, that is, to divide the flowing energy into internal cycling energy and external output energy.

SUMMARY OF THE INVENTION

The present invention has been made to overcome or alleviate at least one aspect of the above mentioned disadvantages or drawbacks of the prior arts. Accordingly, it is an object of the present invention to provide an internal-combustion engine technology and structure, which enables energy flowing to break away from the situation where efficiency of the internal-combustion engine is restricted or limited by mechanical load of the crank link system of the conventional reciprocating internal-combustion engine. More particularly, it relates to a cylinder linkage method for a multi-cylinder internal-combustion engine and a multi-cylinder linkage compound internal-combustion engine manufactured by the cylinder linkage method for a multi-cylinder internal-combustion engine.

According to an aspect of the present invention, there is provided a cylinder linkage method for a multi-cylinder internal-combustion engine, it is characterized in that, piston rods and pistons of four or more linkage combustion and compression reversible cylinder blocks, and piston rods and pistons of reversible precompression cylinder blocks are simultaneously connected by one linkage rod, such that the linkage rod is able to drive all the linkage pistons to move in the same direction simultaneously and to arrive at a top dead center or a bottom dead center or any same stroke position between the two dead centers of all the linkage cylinder blocks simultaneously.

All of the above cylinder blocks have the same working strokes, and each of cylinder blocks requires spacial fixation that axes of cylinder bodies are in parallel with each other.

The above combustion and compression reversible cylinder blocks are closed cylinder bodies each having two heads, one is a cylinder head of a four-stroke internal-combustion engine with its assembly, and the other is a cylinder seat of a two-stroke reversible compressor with its assembly, such that both sides of each of the pistons are provided with a respective gas combustion chamber for four-stroke internal-combustion engine thermal cycle and a respective air compression chamber for two-stroke compressor pumping cycle.

The above piston rods of all the linkage cylinder blocks each have one end connected to the piston in the air compression chamber, and all the other ends of the piston rods are connected to the linkage rod outside the cylinder bodies, wherein all of the pistons, the piston rods and the linkage rods are fixedly integrated, and said piston rods are piston rods with crosshead.

Piston lubricating systems may be provided in the air compression chambers of all the combustion and compression reversible cylinder blocks.

The above gas combustion chambers for performing work stroke have mount directions opposed to those of the gas combustion chambers for performing exhaust stroke, to ensure the work for forced exhaust process is directly transferred from expansion work of the working fluid or is converted from expansion work of the working fluid by conservative force.

The above gas combustion chambers of the combustion and compression reversible cylinder blocks for performing intake stroke have the same mount directions as the gas combustion chambers of the combustion and compression reversible cylinder blocks for performing work stroke, and the gas combustion chambers for performing compression stroke have the same mount directions as the gas combustion chambers for performing exhaust stroke.

According to another aspect of the present invention, there is provided a multi-cylinder linkage compound internal-combustion engine manufactured by a cylinder linkage method for a multi-cylinder internal-combustion engine, it is characterized in that, external working fluid arrives at inlet valves of air compression chambers of a primary-level reversible precompression cylinder block after passing through a working fluid filter, and all outlet valves of the air compression chambers of the reversible precompression cylinder blocks are in communication with the same level precompression intercooler chambers, inlet valves of the air compression chambers of every level reversible precompression cylinder blocks are in communication with previous level precompression intercooler chambers, and a last level precompression intercooler chamber is in communication with inlet valves of air compression chambers of all combustion and compression reversible cylinder blocks, all outlet valves of the air compression chambers of the combustion and compression reversible cylinder blocks are in communication with combustion gas intercooler chamber, the combustion gas intercooler chamber is in communication with all inlet valves of gas combustion chambers of the combustion and compression reversible cylinder blocks, all outlet valves of the gas combustion chambers of the combustion and compression reversible cylinder blocks are in communication with an inlet of a power turbine assembly, reciprocating movement of a piston linkage rod drives a connecting rod to rotate a crank so as to output work of main shaft of internal-combustion engine and enforces high-temperature and high-pressure combusted gas in the gas combustion chambers of the combustion and compression reversible cylinder blocks into the power turbine to work.

The reciprocating movement of the above piston linkage rod only drives the connecting rod to rotate the crank so as to output the work of main shaft of internal-combustion engine while the combusted gas in the gas combustion chambers are discharged directly to the atmosphere as exhaust gas.

The reciprocating movement of the above piston linkage rod enforces the high-temperature and high-pressure combusted gas in the gas combustion chambers of the combustion and compression reversible cylinder blocks into the power turbine to work without driving the connecting rod to rotate the crank so as to output the work of main shaft of internal-combustion engine.

The present invention has the following prominent advantages over the prior art:

According to principle of the shunt of energy, output power is directly transferred to the crank link by use of the linkage piston, and the power turbine assembly is driven to work by forced discharge of the exhaust gas, so that external energy cycle is done. Accordingly, a novel internal-combustion engine is provided, and thermal efficiency is sufficiently utilized.

Instead of conventional cylinder structure, the present invention provides a combustion and compression reversible cylinder block, four-stroke internal-combustion engine thermal cycle process and two-stroke precompression pumping cycle process may be accomplished respectively in the same cylinder block. Single-sided operation characteristic of conventional internal-combustion engine is avoided while the power efficiency is doubled.

By virtue of rigid linkage piston, relative spatial position among these linkage pistons of every cylinder blocks is unchangeable in structure, motion trace of the linkage piston is kept by the crosshead, and cylinder linkage technology is adopted in every linkage cylinder blocks, so, when the linkage pistons move, energy exchange among working fluids in every cylinder blocks may be achieved by supporting force of linkage pistons. When speed of the linkage pistons changes, by means of mass force of the linkage pistons, internal energy of the working fluids in every cylinder blocks and kinetic energy of the linkage pistons may be converted into each other. Theoretically, since both the supporting force and the mass force are of conservative force, loss of the converting of the above two kinds of energy may be neglected. The piston linkage rod is designed and manufactured to have an appropriate structure which may sufficiently load internal energy flow required by internal-combustion engine technology. Thus, by adoption of cylinder linkage technology, definition of load limit of compression ratio of routine internal-combustion engine is meaningless. The key for limitation of thermal efficiency of internal-combustion engine may be the problem of high temperature nitrogen oxide in combustion system, which may bring the compression ratio and cycle mode enormously change.

Obviously, assuming that there is a reversible operating four-stroke cylinder block which owns both charge efficiency of two-stroke cylinder block and gas exchange efficiency of common four-stroke cylinder block, however, reversible combustion violently deteriorates thermal load problem and lubrication problem of reversible four-stroke cylinder block, etc., and these problems are difficult to be solved. In the case that one four-stroke internal-combustion engine thermal cycle process in the gas combustion chamber of the combustion and compression reversible cylinder block is sufficient for two two-stroke precompression pumping cycle process in the air compression chamber, precompressed working fluid, which is as twice as the volume of the gas combustion chamber, accumulated in the combustion gas intercooler chamber makes the gas combustion chamber obtain double charge of the working fluid, the combustion and compression reversible cylinder block therefore achieves operation effect equal to that of reversible operating four-stroke cylinder block.

Precompression cycle process in the air compression chamber of the combustion and compression reversible cylinder block has low temperature and low pressure relatively, so, the use of cylinder block in combustion and compression reversible mode greatly alleviates design problems of thermal load and lubrication. Moreover, the precompression intercooling characteristic further improves thermal efficiency. Multi-level compression and intercooling measures of the prepositive working fluid precompressor are extension and enlargement of such effect.

Every time the linkage pistons carry out a complete stroke process, complete working fluid strokes can be found in the group of linkage combustion and compression reversible cylinder blocks with opposed arrangement characteristic simultaneously to correspond to four-strokes (the intake stroke, the compression stroke, the work stroke, the exhaust stroke) of internal-combustion engine, one by one, the intake stroke and the work stroke always have the same direction with that of movement of the linkage pistons, and the compression strokes and the exhaust strokes always have the opposite direction with that of movement of the linkage pistons; and the intake strokes of the two air compression chambers can always be found to have the same direction with that of movement of the linkage pistons, and the compression strokes of the two air compression chambers have an opposite direction with that of movement of the linkage pistons. Thus, when the group of linkage combustion and compression reversible cylinder blocks with opposed arrangement characteristic is in cycle, only one integrated stroke effect is achieved in the movement direction of the linkage pistons. In addition, when each reversible air pump unit of a working fluid precompressor is in cycle, each stroke includes the intake stroke motion having the same direction as that of movement of linkage pistons and the air compression and pumping stroke motion having the direction opposite to that of movement of linkage pistons. Thus, multi-cylinder linkage compound internal-combustion engine with opposed arrangement characteristic achieves only one integrated stroke effect in the movement direction of the linkage pistons. And, each of the stroke processes offers a transferring process with same work and force to the crank link system being attached.

By utilizing high-rated low-loss internal energy flow brought by the cylinder linkage technology, multi-cylinder linkage compound internal-combustion engine may directly adopt the linkage pistons to drive the combusted gas to carry out high-pressure forced gas exhaust throughout the exhaust stroke, instead of free gas exhaust process in the exhaust stroke. With the high-pressure forced gas exhaust characteristic, the working fluid, at a pressure no less than a pressure that the working fluid has when the work stroke ends, is introduced into the power turbine assembly. Obviously, theoretically, working fluid in multi-cylinder linkage compound internal-combustion engine does not produce any additional loss from work of the cylinder to work of the turbine, which is unbelievable to the internal-combustion engine of exhaust gas turbine pressure type and will bring better thermal work transfer efficiency to multi-cylinder linkage compound internal-combustion engine.

Outstanding efficacy may be achieved if the technology according to the present invention is in combination with low elimination of heat (i.e. adiabatic) internal-combustion engine technology.

The present invention may be used to manufacture internal-combustion engines of various types.

Figure 1:
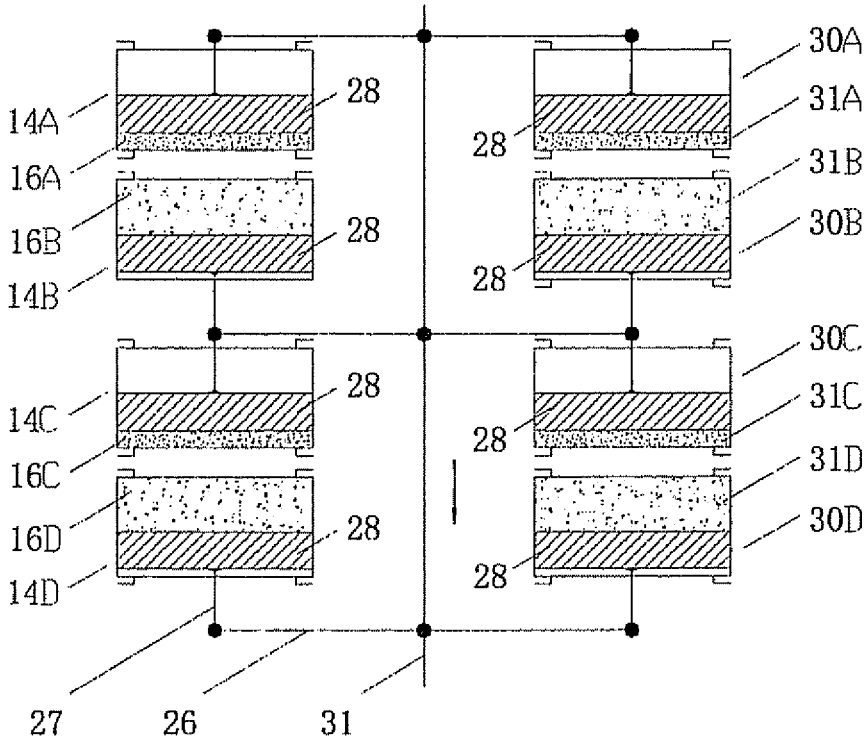
FIG. 1 shows a schematic view of the principle of four-stroke operation of a combustion and compression reversible cylinder block in an opposed arrangement according to the present invention.

Wherein the reference numerals designates the component as follows:1—working fluid filter;

2A, 2B—inlet valve of air compression chamber of primary-level reversible precompression cylinder block;

3—primary-level reversible precompression cylinder block;

4A, 4B—air compression chamber of primary-level reversible precompression cylinder block;

5A, 5B—outlet valve of air compression chamber of primary-level reversible precompression cylinder block;

6—primary-level precompression intercooler chamber;

7A, 7B—inlet valve of air compression chamber of secondary-level reversible precompression cylinder block;

8—secondary-level reversible precompression cylinder block;

9A, 9B—air compression chamber of secondary-level reversible precompression cylinder block;

10A, 10B—outlet valve of air compression chamber of secondary-level reversible precompression cylinder block;

11—secondary-level precompression intercooler chamber;

12—tubes;

13A, 13B, 13C, 13D—inlet valve of air compression chamber of combustion and compression reversible cylinder block;

14A, 14B, 14C, 14D, 30A, 30B, 30C, 30D—combustion and compression reversible cylinder block;

15A, 15B, 15C, 15D—air compression chamber of combustion and compression reversible cylinder block;

16A, 16B, 16C, 16D, 31A, 31B, 31C, 31D—gas combustion chamber of combustion and compression reversible cylinder block;

17A, 17B, 17C, 17D—outlet valve of air compression chamber of combustion and compression reversible cylinder block;

18—combustion gas intercooler chamber;

19A, 19B, 19C, 19D—inlet valve of gas combustion chamber of combustion and compression reversible cylinder block;

20A, 20B, 20C, 20D—outlet valve of gas combustion chamber of combustion and compression reversible cylinder block;

21—power turbine assembly;

22—exhaust outlet of a multi-cylinder linkage compound internal-combustion engine;

23—linkage pistons;

24—connecting rod;

25—crank;

26—linkage rod;

27—piston rod;

28—piston;

29—impeller compressor;

30—combustion and compression reversible cylinder body;

301—cylinder cap of combustion and compression reversible cylinder block;

302—cylinder seat of combustion and compression reversible cylinder block;

DETAILED DESCRIPTION OF PREFERRED EMBODIMENTS OF THE INVENTION

The present invention will be further described in the manner of embodiments hereinafter.

Refer to FIGS. 1-5, a cylinder linkage method for a multi-cylinder internal-combustion engine is a method in which piston rods 27 and pistons 28 of four or more linkage combustion and compression reversible cylinder blocks 14A, 14B, 14C, 14D, 30A, 30B, 30C, 30D, and reversible precompression cylinder blocks 3, 8 are simultaneously fixedly connected by one linkage rod 26. The linkage rod 26 is able to drive all the linkage pistons 28 to move in the same direction simultaneously and to arrive at a top dead center or a bottom dead center or any same stroke position between the top and bottom dead centers of all the linkage cylinder blocks 3, 8, 14A, 14B, 14C, 14D, 30A, 30B, 30C, 30D simultaneously.

All of the above cylinder blocks 3, 8, 14A, 14B, 14C, 14D, 30A, 30B, 30C, 30D have the same working strokes, and each of cylinder blocks 3, 8, 14A, 14B, 14C, 14D, 30A, 30B, 30C, 30D requires spacial fixation so that axes of cylinder bodies are parallel to each other.

The above combustion and compression reversible cylinder blocks 14A, 14B, 14C, 14D, 30A, 30B, 30C, 30D are closed cylinder bodies each having two heads, one is a cylinder head of a four-stroke internal-combustion engine with its assembly, and the other is a cylinder seat of a two-stroke reversible compressor with its assembly, such that both sides of the pistons are provided with respective gas combustion chambers 16A, 16B, 16C, 16D, 31A, 31B, 31C, 31D for four-stroke internal-combustion engine thermal cycle and the respective air compression chambers 15A, 15B, 15C, 15D for two-stroke compressor pumping cycle.

The piston rods 27 of all the above linkage combustion and compression reversible cylinder blocks each has one end connected to the piston 28 in the air compression chamber, and all of the other ends of the piston rods are connected to the linkage rod outside the cylinder bodies. All of the pistons, the piston rods and the linkage rods are fixedly integrated, and said piston rods are piston rods with crosshead.

Piston lubricating systems may be provided in the air compression chambers of all the above combustion and compression reversible cylinder blocks.

All the above gas combustion chambers 16B, 31B for performing work stroke have mount directions opposed to those of the gas combustion chambers 16A, 31A for performing exhaust stroke, so as to ensure work for forced exhaust process is directly transferred from expansion work of the working fluid or is converted from expansion work of the working fluid by conservative force (see FIG. 1).

All the above gas combustion chambers 16D, 31D of the combustion and compression reversible cylinder blocks for performing intake stroke have the same mount directions as the gas combustion chambers 16B, 31B of the combustion and compression reversible cylinder blocks for performing work stroke, and the gas combustion chambers 16C, 31C for performing compression stroke have the same mount directions as the gas combustion chambers 16A, 31A for performing exhaust stroke (see FIG. 1).

There is provided a multi-cylinder linkage compound internal-combustion engine manufactured by a cylinder linkage method for a multi-cylinder internal-combustion engine, in which external working fluid arrives at the inlet valves 2A, 2B of air compression chambers 4A, 4B of a primary-level reversible precompression cylinder block 3 after passing through a working fluid filter 1, and all outlet valves 5A, 5B, 10A, 10B of air compression chambers 4A, 4B, 9A, 9B of reversible precompression cylinder blocks 3, 8 are in communication with the same level precompression intercooler chambers 6, 11, inlet valves 7A, 7B of the air compression chambers 9A, 9B of every level reversible precompression cylinder blocks 3, 8 are in communication with the previous level precompression intercooler chambers 6, and the last level precompression intercooler chamber 11 is in communication with inlet valves 13A, 13B, 13C, 13D of air compression chambers 15A, 15B, 15C, 15D of all combustion and compression reversible cylinder blocks 14A, 14B, 14C, 14D, 30A, 30B, 30C, 30D, all outlet valves 17A, 17B, 17C, 17D of the air compression chambers 14A, 14B, 14C, 14D, 30A, 30B, 30C, 30D of the combustion and compression reversible cylinder blocks are in communication with combustion gas intercooler chamber 18, the combustion gas intercooler chamber 18 is in communication with all inlet valves 19A, 19B, 19C, 19D of gas combustion chambers 16A, 16B, 16C, 16D, 31A, 31B, 31C, 31D of the combustion and compression reversible cylinder blocks 14A, 14B, 14C, 14D, 30A, 30B, 30C, 30D, all outlet valves 20A, 20B, 20C, 20D of gas combustion chambers 16A, 16B, 16C, 16D, 31A, 31B, 31C, 31D of the combustion and compression reversible cylinder blocks 14A, 14B, 14C, 14D, 30A, 30B, 30C, 30D are in communication with an inlet of a power turbine assembly 21, reciprocating movement of linkage pistons 23 drives a connecting rod 24 and a crank 25 so as to output work of main shaft of internal-combustion engine and enforces high-temperature and high-pressure combusted gas in the gas combustion chambers 16A, 16B, 16C, 16D, 31A, 31B, 31C, 31D of the combustion and compression reversible cylinder blocks 14A, 14B, 14C, 14D, 30A, 30B, 30C, 30D into the power turbine assembly 21 to work.

The above reciprocating movement of the linkage pistons 23 only drives the connecting rod 24 and the crank 25 so as to output the work of main shaft of internal-combustion engine while the combusted gas in the gas combustion chambers 16A, 16B, 16C, 16D, 31A, 31B, 31C, 31D are discharged directly to the atmosphere as exhaust gas.

The reciprocating movement of the linkage pistons 23 enforces the high-temperature and high-pressure combusted gas in the gas combustion chambers 16A, 16B, 16C, 16D, 31A, 31B, 31C, 31D of the combustion and compression reversible cylinder blocks 14A, 14B, 14C, 14D, 30A, 30B, 30C, 30D into the power turbine 21 to work without driving the connecting rod 24 and the crank 25 so as to output the work of main shaft of internal-combustion engine.

Figure 2:
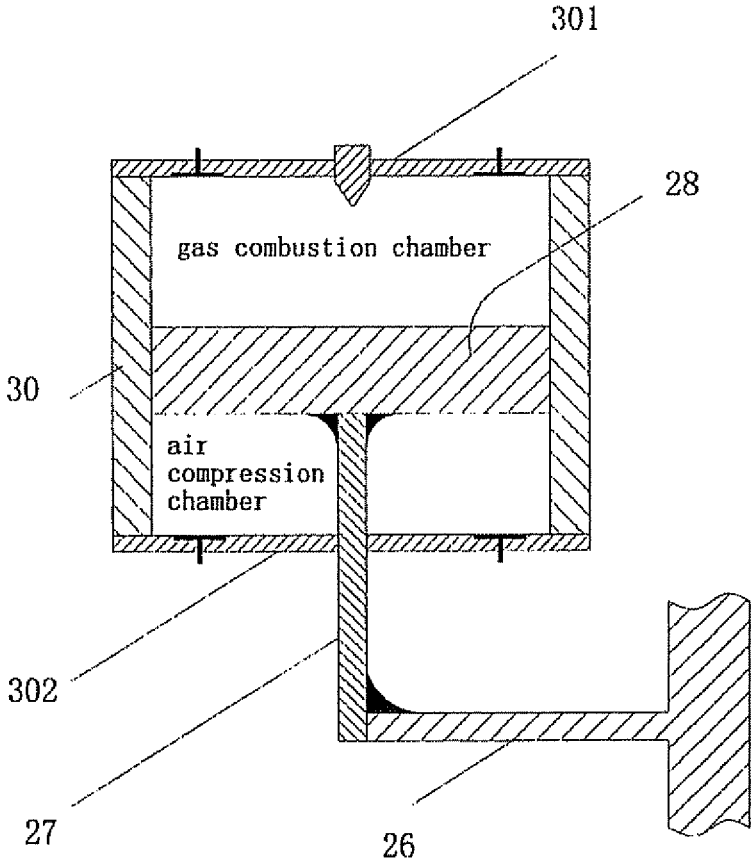
FIG. 2 shows a schematic view of internal structure of a combustion and compression reversible cylinder block according to the present invention.
Figure 3:
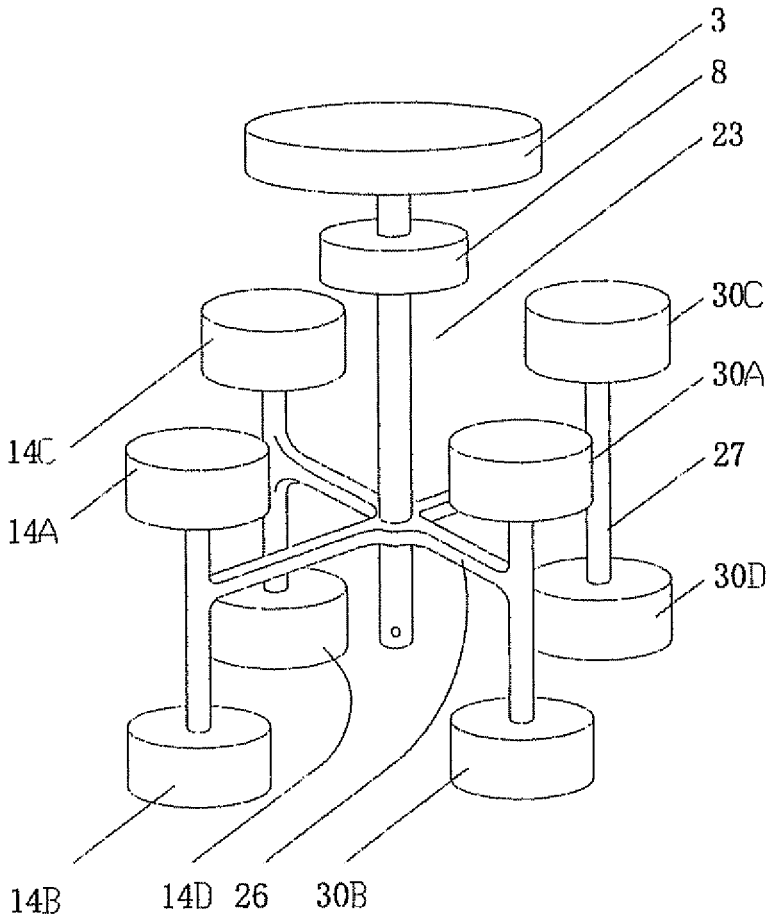
FIG. 3 shows a schematic view of structural principle of a cylinder linkage method for a multi-cylinder internal-combustion engine according to the present invention.
Figure 4:
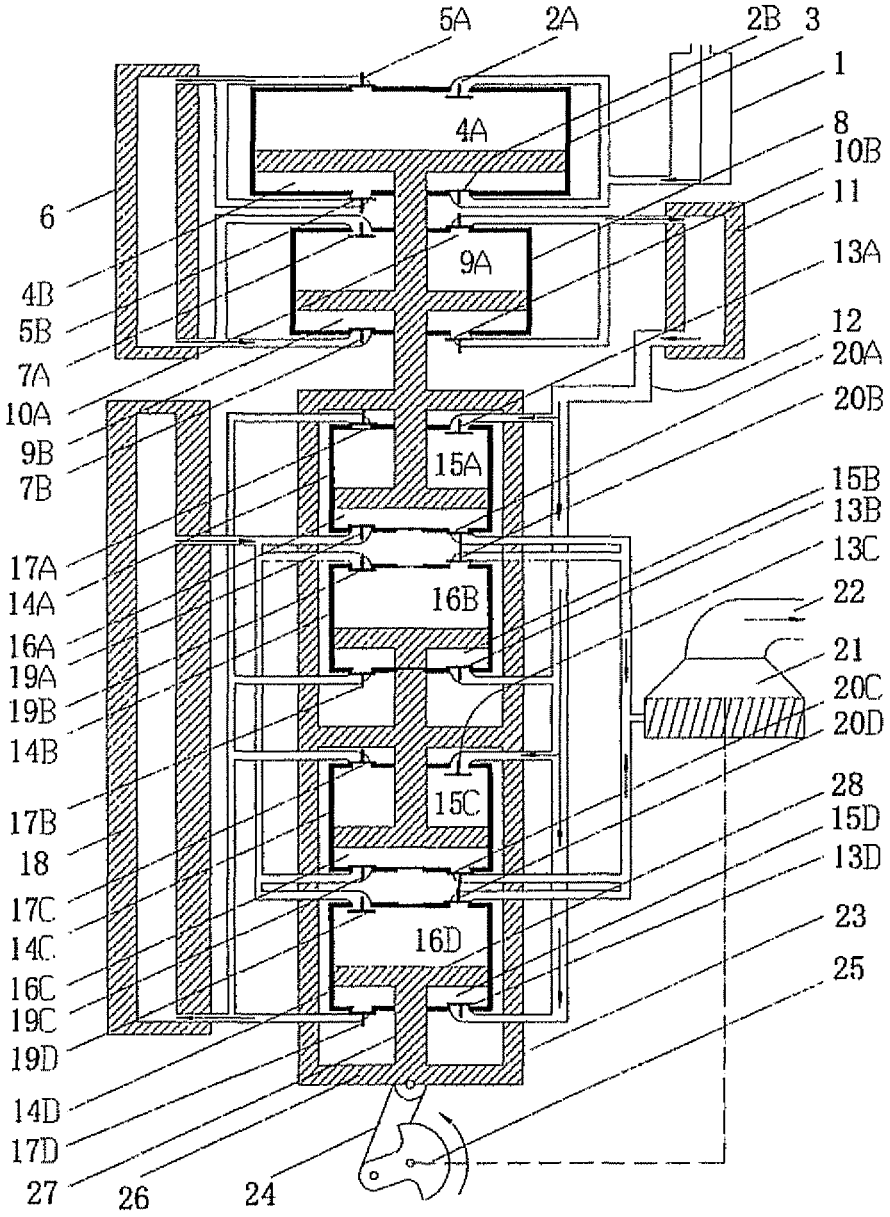
FIG. 4 shows a schematic view of structural principle of a multi-cylinder linkage compound internal-combustion engine according to the present invention.
Figure 5:
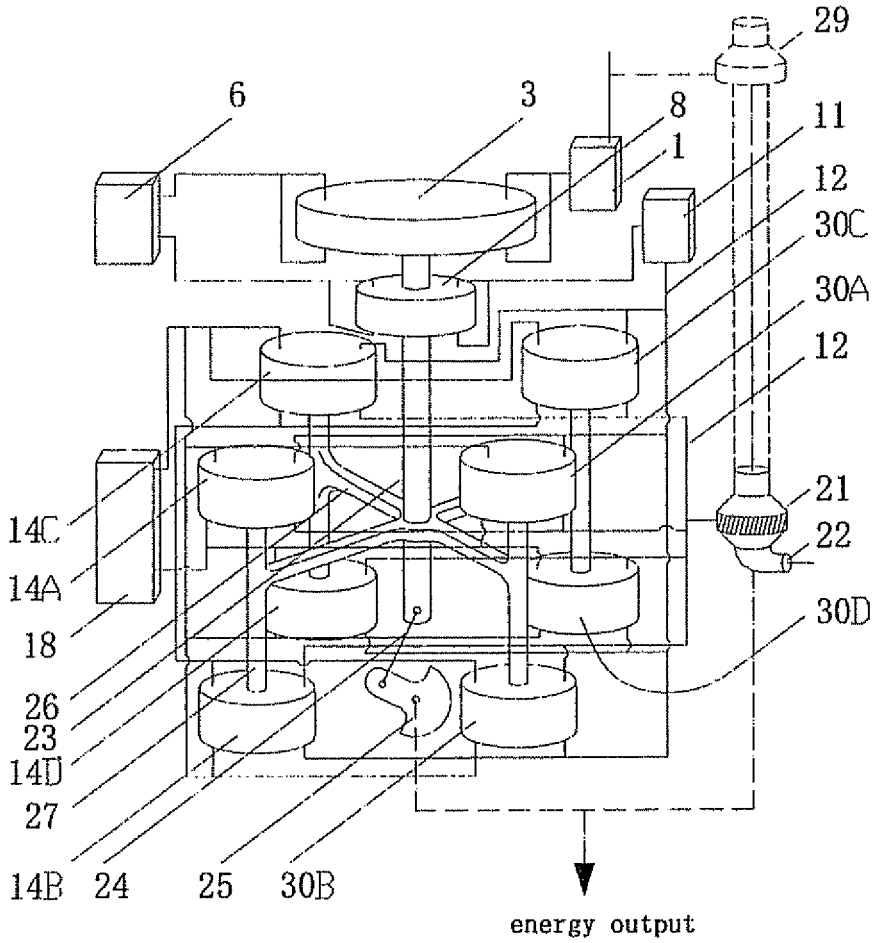
FIG. 5 shows a simply schematic view of structural arrangement of a multi-cylinder linkage compound internal-combustion engine according to the present invention.

The combustion and compression reversible cylinder blocks 30A, 30B, 30C, 30D and the combustion and compression reversible cylinder blocks 14A, 14B, 14C, 14D, in FIGS. 2 and 3, have the same structure, and both are in an opposed arrangement, so as to enhance work capacity of the internal-combustion engine and torque to the linkage pistons 23 during a balance work.

The cylinder linkage method for a multi-cylinder internal-combustion engine may be used for manufacturing various types of gasoline internal-combustion engine, diesel internal-combustion engine, etc. One of the differences between the gasoline internal-combustion engine and the diesel internal-combustion engine is the method and the structure of oil injection ignition, which is well-known. Of course, it also may be used for manufacturing internal-combustion engine using natural gas or other fuel.

Mechanical Structure:

The core part of the present invention is a combustion gas generator. The main part of the combustion gas generator is the combustion and compression reversible cylinder blocks 14A, 14B, 14C, 14D, 30A, 30B, 30C, 30D. The pistons 28 divide the combustion and compression reversible cylinder blocks 14A, 14B, 14C, 14D, 30A, 30B, 30C, 30D into the gas combustion chambers 16A, 16B, 16C, 16D, 31A, 31B, 31C, 31D and the air compression chambers 15A, 15B, 15C, 15D, respectively. The air compression chambers, cylinder seats and their assemblies of the combustion and compression reversible cylinder blocks 30A, 30B, 30C, 30D are not shown in the figures. Cylinder caps of the gas combustion chambers are configured according to a cylinder cap of four-stroke internal-combustion engine, and the cylinder seats of the gas combustion chambers are configured according to a cylinder seat of two-stroke reversible piston compressor. The lubrication of cylinder bodies and the pistons is provided in the air compression chambers. Eight units (or sixteen units) of completely the same combustion and compression reversible cylinder blocks are arranged in an opposed manner. By adoption of the cylinder linkage technique, the pistons in the cylinders are rigidly and fixedly integrated by the linkage rod 26 and the piston robs 27. The connecting rod 24 and the crank 25 are connected below the linkage pistons 23, by adopting the layout of crank link system in conventional internal-combustion engine in the crosshead type. The combustion gas intercooler chamber 18 is in communication with the outlet valves 17A, 17B, 17C, 17D of the air compression chambers of the combustion and compression reversible cylinder blocks and the inlet valves 19A, 19B, 19C, 19D of the gas combustion chambers of combustion and compression reversible cylinder blocks by tubes. All the above elements constitute the combustion gas generator of the present invention. The reversible precompression cylinder block 3 and precompression intercooler chamber 6 to constitute a primary-level air pump of a working fluid precompressor, and the reversible precompression cylinder block 8 and the precompression intercooler chamber 11 to constitute a secondary-level air pump are configured according to mature positive displacement two-stroke reversible air compressor technology. The inlet valves 2A, 2B of the air compression chambers 4A, 4B of the primary-level reversible precompression cylinder blocks are in communication with the working fluid filter 1 for entering air, the secondary-level precompression intercooler chamber 11 is in communication with the inlet valves 13A, 13B, 13C, 13D of the air compression chambers of the combustion and compression reversible cylinder blocks by tubes 12. The primary-level precompression intercooler chamber 6 is in communication with the outlet valves 5A, 5B of the primary-level reversible precompression cylinder block and the inlet valves 7A, 7B of the secondary-level reversible precompression cylinder block, the outlet valves 10A, 10B of the secondary-level reversible precompression cylinder block are in communication with the secondary-level precompression intercooler chamber 11. According to multi-level matching principle of the positive displacement gas compressor, volume of working fluid when a preset compression ratio is achieved in the air compression chambers 9A, 9B of the secondary-level reversible precompression cylinder block is necessarily as twice as capacity of the air compression chambers 15A, 15B, 15C, 15D of the combustion and compression reversible cylinder blocks, while volume of working fluid when a preset compression ratio is achieved in the air compression chambers 4A, 4B of the primary-level reversible precompression cylinder block is necessarily equal to capacity of the secondary-level air compression chambers 9A, 9B. The power turbine assembly 21 is configured according to a low-pressure turbine assembly of a gas turbine machine, the inlet of the power turbine assembly 21 is in communication with the outlet valves 20A, 20B, 20C, 20D of the gas combustion chambers of the combustion and compression reversible cylinder blocks, while the outlet of the power turbine assembly 21 is in communication with an exhaust outlet 22 of the multi-cylinder linkage compound internal-combustion engine.

Working fluid Process (primarily see FIG. 4):

Along with up-and-down movement of the linkage pistons 23, external working fluid enters, passes through and flows out of the apparatus of the present invention in sequence. When the linkage piston 23 moves down, the inlet valve 2A of the primary-level air compression chamber opens, external working fluid enters the primary-level air compression chamber 4A via the working fluid filter 1, while the previous working fluid, which has entered the primary-level air compression chamber 4B through the working fluid filter 1, in the primary-level air compression chamber 4B will be compressed to reach a preset compression ratio, and then, the outlet valve 5B of the primary-level air compression chamber 4B opens, and the working fluid is pumped into the primary-level precompression intercooler chamber 6. In the same way, the inlet valve 7A of the secondary-level air compression chamber 9A opens, working fluid enters the secondary-level air compression chamber 9A from the primary-level precompression intercooler chamber 6, the working fluid in the secondary-level air compression chamber 9B will be compressed to reach a preset compression ratio, and then, the outlet valve 10B of the secondary-level air compression chamber opens, and the working fluid is pumped into the secondary-level precompression intercooler chamber 11. Working fluid precompressed by the working fluid precompressor flows from the secondary-level precompression intercooler chamber 11 to the combustion gas generator through the tubes 12. During the down movement of the linkage pistons 23, the inlet valves 13A, 13C of the air compression chambers of the combustion and compression reversible cylinder blocks open, working fluid enters the air compression chambers 15A, 15C of the combustion and compression reversible cylinder blocks from the secondary-level precompression intercooler chamber 11 through the tubes 12, while the previous working fluid in the air compression chambers 15B, 15D of the combustion and compression reversible cylinder blocks will be compressed, and at a suitable time (when the previous working fluid in the air compression chambers 15B, 15D is compressed to reach about ½ of the preset compression ratio), the outlet valves 17B, 17D of the air compression chambers of the combustion and compression reversible cylinder blocks open and the working fluid is pumped into the combustion gas intercooler chamber 18. By now, the precompression intercooler process of the working fluid ends. When the linkage pistons 23 move up, vice versa, the inlet valves 2B, 7B, 13B, 13D open, working fluid enters the air compression chambers 4B, 9B and the air compression chamber 15B, 15D, the outlet valve 5A, 10A, 17A, 17C open, working fluid in the air compression chambers 4A, 9A and the air compression chamber 15A, 15C is pumped into the precompression intercooler chambers 6, 11, 18. Because the gas combustion chambers 16A, 16B, 16C, 16D of the combustion and compression reversible compression cylinder blocks perform internal-combustion engine four-stroke cycle, working fluid flowing in/out the gas combustion chambers 16A, 16B, 16C, 16D of the combustion and compression reversible compression cylinder blocks should be explained by Strokes I, II, II, IV, in which Strokes I, III are downward strokes and Strokes II, IV are upward strokes. During the process of Stroke I, the inlet valve 19D of the gas combustion chamber of the combustion and compression reversible cylinder block opens, working fluid enters the gas combustion chamber 16D of the combustion and compression reversible cylinder block from the combustion gas intercooler chamber 18, the outlet valve 20A of the gas combustion chamber of the combustion and compression reversible cylinder block opens, working fluid is pressed into the power turbine assembly 21 from the gas combustion chamber 16A of the combustion and compression reversible cylinder block. After the stroke begins, working fluid and fuel in the gas combustion chamber 16B of the combustion and compression reversible cylinder block enter a heating process. The intake stroke of the gas combustion chamber 16D of the combustion and compression reversible cylinder block, the compression stroke of the gas combustion chamber 16C, the work stroke of the gas combustion chamber 16B, the exhaust stroke of the gas combustion chamber 16A, are performed during the whole downward stroke of the linkage pistons 23.

In the same way, during the process of Stroke II, the inlet valve 19A of the gas combustion chamber of the combustion and compression reversible cylinder block and the outlet valve 20B of the gas combustion chamber of the combustion and compression reversible cylinder block open, the intake stroke of the gas combustion chamber 16A of the combustion and compression reversible cylinder block, the compression stroke of the gas combustion chamber 16D, the work stroke of the gas combustion chamber 16C, the exhaust stroke of the gas combustion chamber 16B, are performed during the whole upward stroke of the linkage pistons 23.

In the same way, during the process of Stroke III, the inlet valve 19B of the gas combustion chamber of the combustion and compression reversible cylinder block and the outlet valve 20C of the gas combustion chamber of the combustion and compression reversible cylinder block open, the intake stroke of the gas combustion chamber 16B of the combustion and compression reversible cylinder block, the compression stroke of the gas combustion chamber 16A, the work stroke of the gas combustion chamber 16D, the exhaust stroke of the gas combustion chamber 16C, are performed during the whole downward stroke of the linkage pistons 23.

In the same way, during the process of Stroke IV, the inlet valve 19C of the gas combustion chamber of the combustion and compression reversible cylinder block and the outlet valve 20D of the gas combustion chamber of the combustion and compression reversible cylinder block open, the intake stroke of the gas combustion chamber 16C of the combustion and compression reversible cylinder block, the compression stroke of the gas combustion chamber 16B, the work stroke of the gas combustion chamber 16A, the exhaust stroke of the gas combustion chamber 16D, are performed during the whole upward stroke of the linkage pistons 23. Only one gas combustion chamber of the combustion and compression reversible cylinder block performs one of the four-stroke processes, that is, the intake stroke, the compression stroke, the work stroke, the exhaust stroke, but the same gas combustion chamber performs different strokes in a cycle. The opposed arrangement feature of the combustion and compression reversible cylinder block according to the present invention is feasible because the linkage pistons 23 are fixedly and coaxially provided. The result is that, all the strokes in the movement direction of the linkage pistons 23 according to the present invention, achieves only one integrated stroke effect. When working fluid arrives at the power turbine assembly 21, the impulse type stroke cycle is completely finished. During the above working fluid flowing process, so long as all the exhaust tubes of the gas combustion chamber 16A, 16B, 16C, 16D of the combustion and compression reversible cylinder block are connected to the same gas inlet of the power turbine assembly 21, due to the high-pressure enforcing gas exhaust feature, a stable working fluid continuous cycle characteristic of the impeller mechanism may be achieved in the power turbine assembly 21 when the speed of rotation of the internal-combustion engine is steady. After the cycle of the impeller mechanism, working fluid under a condition of near atmospheric pressure is discharged to outside by the exhaust outlet 22 of the multi-cylinder linkage compound internal-combustion engine.

Energy Flow Process (Primarily See FIG. 4):

Since feedback of energy is cancelled and the combustion services as energy source, the combustion and compression reversible cylinder block becomes only energy outflow subsystem (energy source system) in the work performing strokes, while all other sub-systems associated with the energy flow process, such as cylinder blocks, crank link, power turbine assembly, etc., even including the loss from the mechanical movement, are energy consumption units or energy receiving units. The combustion and compression reversible cylinder blocks perform internal-combustion engine four-stroke cycle, which necessarily results in the fact that the gas combustion chamber for work stroke can not be continuously provided by one combustion and compression reversible cylinder block. However, based on cylinder linkage technology features, opposed arrangement of cylinder blocks and coaxial mounting of linkage cylinder, the work strokes appear in different combustion and compression reversible cylinder blocks in turn in accordance with stroke cycle, and the linkage mechanical energy flow process started with the work stroke is not affected. Hence, to the energy cycle flow process of the present invention, there is no difference between the explanation of single stroke and that of multi-strokes. In other words, energy flow process of any stroke of the multi-cylinder linkage internal-combustion engine may illustrate or represent energy flow process of all cycle processes.

First of all, beginning with the energy source, in this case, the gas combustion chamber 16B of the combustion and compression reversible cylinder block performs the work stroke. When the stroke begins, the linkage pistons 23 start to move down, working fluid in the gas combustion chamber 16B for performing the work stroke starts to expand by heat (combustion expansion), in a normal instance, whatever working fluid expands by the heat in the earlier stage or adiabatically expands in the later stage, with the process of the stroke, in general, pressure of working fluid gradually descends. In contrast, working fluid in the gas combustion chamber 16C of the combustion and compression reversible cylinder blocks for performing the compression stroke has pressure gradually ascending with the process of the stroke, the gas combustion chamber for performing the work stroke and the gas combustion chamber for performing the compression stroke dominate energy flow process of the whole machine, in which the condition of working fluid generally determines the motion law of the linkage pistons 23. The gas combustion chamber 16D of the combustion and compression reversible cylinder blocks performs the intake stroke, and pressure of working fluid in the gas combustion chamber 16D is slightly less than pressure in the combustion gas intercooler chamber 18. The gas combustion chamber 16A of the combustion and compression reversible cylinder blocks performs the exhaust stroke, and pressure of working fluid in the gas combustion chamber 16A is slightly higher than pressure in the inlet of the power turbine assembly 21. The air compression chambers 15A, 15C of the combustion and compression reversible cylinder block perform intake stroke, and pressure of working fluid in air compression chambers 15A, 15C is slightly less than pressure in the secondary-level precompression intercooler chamber 11 of the reversible precompression cylinder block. The secondary-level air compression chamber 9A of the reversible precompression cylinder block performs the intake stroke, and pressure of working fluid in the secondary-level air compression chamber 9A is slightly less than pressure in the primary-level precompression intercooler chamber 6 of the reversible precompression cylinder block. The primary-level air compression chamber 4A of the reversible precompression cylinder block performs the intake stroke, and pressure of working fluid in the primary-level air compression chamber 4A is slightly less than pressure in the outside. The above pressures of working fluid generally are stable or changeless with the progress of the strokes. Final pressure of working fluid in the primary-level air compression chamber 4B of the reversible precompression cylinder block is slightly higher than pressure in the primary-level precompression intercooler chamber 6 of the reversible precompression cylinder block. Final pressure of working fluid in the secondary-level air compression chamber 9B of the reversible precompression cylinder block is slightly higher than pressure in the secondary-level precompression intercooler chamber 11 of the reversible precompression cylinder blocks. Final pressure of working fluid in the air compression chambers 15B, 15D of the combustion and compression reversible cylinder blocks is slightly higher than pressure in the combustion gas intercooler chamber 18. The above strokes are the air pumping strokes. Pressure of working fluid regularly ascends in earlier stage. When reaching a preset compression ratio, pressure of working fluid is generally maintained without change as the outlet valves open. Apparently, the systems according to the present invention achieve energy flow only by the piston linkage rod. The motion of the linkage piston 23 determines the energy flow process in the present invention. Only the gas combustion chambers performing the work stroke drive the linkage piston 23 to move, but all the other systems including the power turbine and the crank-connecting rod system which have not been described consume kinetic energy of the linkage piston 23. Thus, at the beginning of the stroke, pressure of working fluid of the gas combustion chamber 16B for performing the work stroke is the pressure occurring when the compression stroke ends. In addition, the working fluid in the gas combustion chamber 16B for performing the work stroke is in a condition of expansion by the heat, while working fluids in other cylinders generally in a condition of relatively low pressure, especially, in the gas combustion chamber 16C for performing the compression stroke, the working fluid in the gas combustion chamber 16C just starts to be compressed after the intake stroke, so at the earlier stage of the stroke, the linkage piston 23 is in a condition of acceleration, most of energy outputted from the gas combustion chamber 16B for performing the work stroke is used to be converted to kinetic energy of the piston linkage rod while only a little of energy is consumed directly in the systems. With the progress of the stroke, the pressure of working fluid of the gas combustion chamber 16B for performing the work stroke rapidly descends especially when working fluid of the gas combustion chamber 16B for performing the work stroke converts from a condition of expansion by the heat to a condition of adiabatic expansion. Contrary, with the progress of the stroke, pressure of working fluid in the systems for performing the air pumping stroke gradually ascends and the systems successively move into an air exhaust phase where high pressure is continued. Particularly, working fluid of the gas combustion chamber 16C for performing the compression stroke, with the progress of the compression, has a rapidly ascending pressure. So, in the middle phase of the stroke, acceleration of the linkage pistons 23 gradually descends and finally vanishes. Most of energy outputted from the gas combustion chamber 16B for performing the work stroke are consumed for the requirements of the systems while only a little of energy is converted to kinetic energy of the linkage pistons 23. When coming to the late phase of the stroke, working fluid of the gas combustion chamber 16C for performing the compression stroke has the pressure sharply ascends far beyond that of the other cylinder systems, which are in a stable pressure phase. By then, the working fluid of the gas combustion chamber 16B for performing the work stroke has the extremely low pressure, which nearly has no effect on drive of the linkage pistons 23. Apparently, compared to other energy flow system, most of energy from the multi-cylinder linkage compound internal-combustion engine is focused on the conversion from working fluid in the gas combustion chamber for the work stroke to kinetic energy of linkage pistons 23 then to working fluid in the gas combustion chamber for the compression stroke, which is generally similar to the conversion from work stroke to kinetic energy of inertia wheel then to compression stroke of four-stroke internal-combustion engine. The most difference is that there is not a crank link system acting as intermediate mechanical according to the present invention. Due to the existence of inertia, the law of parabolic movement, that is, the movement of the linkage pistons 23 from maximal acceleration to minimal acceleration then to maximal negative acceleration and to a final stop, is quite close to law of sine movement of a crank link system. As such, in the present invention, when in a stable cycle, the rotation speed of the crank is considerably even. According to the present invention, the internal energy cycle is achieve by the cylinders with the linkage pistons 23, while the external energy cycle is achieved by the cycle of the work directly outputted from the crank link system and the work done by impelling power turbine assembly in the process of enforced gas exhaust.

What is claimed is:

1. A mufti-cylinder internal-combustion engine, comprising:

a plurality of cylinder blocks comprising a plurality of combustion and compression reversible cylinder blocks configured to produce work, and a plurality of reversible precompression cylinder blocks configured to pre-compress a working fluid, wherein each of said plurality of cylinder blocks comprising:

a cylinder having a cylinder body;

a piston movable in said cylinder;

a piston rod rigidly connected with said piston; and a linkage rod rigidly connected to each of said piston rod of said plurality of cylinder blocks, wherein said linkage rod and said plurality of piston rods and pistons constitute a rigid integral body, said linkage rod is connected to a crank link system such that the linkage rod is able to rigidly drive said piston of each of said plurality of said cylinder blocks to move in the same direction simultaneously and to arrive at a stroke position between a top dead center and a bottom dead center of said crank link system, wherein each of said plurality of combustion and compression reversible cylinder blocks comprises a closed cylinder body having a cylinder head and an assembly of a four-stroke internal-combustion engine, on one side of said piston, and a cylinder head and an assembly of a two-stroke reversible compressor, on the other side of said piston, wherein said closed cylinder body further comprising a gas combustion chamber for a four-stroke internal-combustion engine thermal cycle and an air compression chamber for a two-stroke compressor pumping cycle, and wherein said plurality of said cylinder blocks further comprising a first subset of cylinder blocks and a second subset of cylinder blocks, wherein the cylinders of said first subset of cylinder blocks are mounted directionally opposed to the cylinders of said second subset of cylinder blocks, and wherein a work stroke in the combustion chamber of said first subset of cylinder blocks causes an exhaust stroke in the combustion chamber of said second subset of cylinder blocks.

2. A mufti-cylinder internal-combustion engine, comprising:

a plurality of cylinder blocks comprising a plurality of combustion and compression reversible cylinder blocks configured to produce work, and a plurality of reversible precompression cylinder blocks configured to pre-compress a working fluid, wherein each of said plurality of cylinder blocks comprising:

a cylinder having a cylinder body;

a piston movable in said cylinder;

a piston rod rigidly connected with said piston; and a linkage rod rigidly connected to each of said piston rod of said plurality of cylinder blocks, wherein said linkage rod and said plurality of piston rods and pistons constitute a rigid integral body, said linkage rod is connected to a crank link system such that the linkage rod is able to rigidly drive said piston of each of said plurality of said cylinder blocks to move in the same direction simultaneously and to arrive at a stroke position between a top dead center and a bottom dead center of said crank link system, wherein each of said plurality of combustion and compression reversible cylinder blocks comprises a closed cylinder body having a cylinder head and an assembly of a four-stroke internal-combustion engine, on one side of said piston, and a cylinder head and an assembly of a two-stroke reversible compressor, on the other side of said piston, wherein said closed cylinder body further comprising a gas combustion chamber for a four-stroke internal-combustion engine thermal cycle and an air compression chamber for a two-stroke compressor pumping cycle, and wherein said plurality of said cylinder blocks further comprising a first, a second, a third and a fourth subsets of cylinder blocks, wherein the cylinders of said first and second subsets of cylinder blocks are mounted in a similar direction, and said third and fourth subsets of cylinder blocks are mounted in similar directions, and wherein a work stroke in the combustion chamber of said first subset of cylinder blocks occurs simultaneously with an intake stroke in the combustion chamber of said second subset of cylinder blocks, and a compression stroke of said third subset of cylinder blocks occurs simultaneously with an exhaust stroke in said fourth subset of cylinder blocks.

3. A mufti-cylinder internal-combustion engine, comprising:

a plurality of cylinder blocks comprising a plurality of combustion and compression reversible cylinder blocks configured to produce work, and a plurality of reversible precompression cylinder blocks configured to pre-compress a working fluid, wherein each of said plurality of cylinder blocks comprising:

a cylinder having a cylinder body;

a piston movable in said cylinder;

a piston rod rigidly connected with said piston; a linkage rod rigidly connected to each of said piston rod of said plurality of cylinder blocks, wherein said linkage rod and said plurality of piston rods and pistons constitute a rigid integral body, said linkage rod is connected to a crank link system such that the linkage rod is able to rigidly drive said piston of each of said plurality of said cylinder blocks to move in the same direction simultaneously and to arrive at a stroke position between a top dead center and a bottom dead center of said crank link system; and a first, a second and a third intercoolers;

said plurality of reversible precompression cylinder blocks further comprising a first-level cylinder block and a second-level cylinder block, wherein each of said plurality of reversible precompression cylinder blocks further comprising:

a first and a second compression chambers;

an inlet valve for each one of said first and second compression chambers;

an outlet valve for each one of said first and second compression chambers;

wherein each of said inlet valves of said first and second compression chambers of said first-level precompression cylinder block are configured for letting an external working fluid into said first compression chamber of said first-level precompression cylinder block after passing through a working fluid filter; wherein each of said outlet valves of said first-level cylinder block are connected to said first intercooler; wherein each of said inlet valve of said second-level precompression cylinder block is connected to said first intercooler; wherein each of said outlet valves of said second-level precompression cylinder block is connnected to said second intercooler;

said plurality of combustion and compression reversible cylinder blocks further comprising:

a combustion chamber having a combustion chamber inlet valve and outlet valve;

a compression chamber having a compression chamber inlet valve and an outlet valve; and each of the inlet valves of said compression chambers of said plurality of combustion and compression reversible cylinder blocks are connected with said second intercooler, wherein each of the outlet valves of said compression chambers of said plurality of combustion and compression reversible cylinder blocks is connected to said third intercooler, wherein each of the inlet valves of each of said combustion chamber of said plurality of combustion and compression reversible cylinder blocks is connected to said third intercooler, and wherein each of the outlet valves of each of said combustion chamber of said plurality of combustion and compression reversible cylinder blocks is connected with an inlet of a power turbine assembly.

4. The multi-cylinder internal-combustion engine of claim 3, further comprising a connecting rod, wherein reciprocating movement of the linkage rod drives only drives the connecting rod to rotate a crank so as to output work of a main shaft of the internal-combustion engine while combusted gas in the gas combustion chambers are discharged directly to the atmosphere as exhaust gas.

5. The multi-cylinder internal-combustion engine of claim 3, further comprising a power turbine, wherein reciprocating movement of the linkage rod enforces high-temperature and high-pressure combusted gas in the gas combustion chambers of the combustion and compression reversible cylinder blocks into the power turbine to work.

6. The mufti-cylinder internal-combustion engine of claim 3, further comprising: a linkage piston assembly, wherein the linkage rod and all the piston rods and pistons connected by the linkage rod constitute the linkage piston assembly, the linkage piston assembly has a rated mass substantially corresponding to a rated power of the mufti-cylinder internal-combustion engine, the linkage piston assembly is matched to the rated mass when a crank link mechanism of the multi-cylinder internal-combustion engine runs at a rated rotation speed.

* * * * *